United States Patent [19]

Rosenbaum

[11] 4,314,432

[45] Feb. 9, 1982

[54] SPLICE FOR BEAM IN SUSPENDED CEILING SYSTEM

[75] Inventor: Per Rosenbaum, Woodbine, Md.

[73] Assignee: Roper Corporation, Kankakee, Ill.

[21] Appl. No.: 130,985

[22] Filed: Mar. 17, 1980

[51] Int. Cl.[3] ..... E04B 5/55; F16B 7/22

[52] U.S. Cl. ..... 52/484; 52/667; 403/363

[58] Field of Search ..... 52/484, 664–667; 403/363

[56] References Cited

U.S. PATENT DOCUMENTS

| | | | |
|---|---|---|---|
| 3,221,466 | 12/1965 | Downing, Jr. et al. | 52/669 X |
| 3,374,596 | 3/1968 | O'Brien et al. | 52/664 |
| 3,565,474 | 2/1971 | Stumbo et al. | 52/667 X |
| 3,979,874 | 9/1976 | Cubbler, Jr. et al. | 52/484 X |
| 4,043,689 | 8/1977 | Spencer et al. | 52/664 X |
| 4,161,856 | 7/1979 | Brown et al. | 52/667 |
| 4,208,851 | 6/1980 | Sauer | 52/667 X |

*Primary Examiner*—J. Karl Bell

*Attorney, Agent, or Firm*—C. Frederick Leydig; Richard L. Voit; David J. Richter

[57] ABSTRACT

For use in a suspended ceiling system a pair of beams joinable end to end in aligned relation, each of the beams having a vertical web and lower flange at right angles thereto. The beams have identically formed end portions each terminating in a horizontal tongue integral with the web. Each web has formed therein a window having an inwardly spaced "locking" edge and having a vertical dimension just slightly greater than the height of the tongue. Each of the tongues is notched and bent along its upper and lower edges to form a pair of integral hooks. The tongues are sufficiently straight with respect to the plane of the web so that when a tongue is received in the window of the companion beam it bears with resilient lateral force against the far edge of the window, insuring that the hooks "catch" behind the locking edge to a desired depth. The tongues may be withdrawn from the windows by a force applied at an angle having a lateral component in a direction to bendingly stress the tongues for disengagement of the hooks. The far edge of each window is formed with an integral tang bent convergently from the plane of the web to engage the tip of an inserted tongue to guide the same into the window, the tang optionally serving as a positive lock.

7 Claims, 10 Drawing Figures

SPLICE FOR BEAM IN SUSPENDED CEILING SYSTEM

In a common form of suspended ceiling system ceiling panels are supported upon a grid formed of metallic main beams, or runners, arranged parallel to one another and which are bridged at intervals by cross beams which intersect the main beams at right angles.

To span a large room the main beams must be provided in sections which are spliced together end to end to form an abutting joint. The joint should be capable of quick and easily assembly, it should be neat and closely fitted, strong and permanent, yet capable of easy disassembly. In one form of joint, or splice, horizontally extending tongues are provided at the ends of the beams, each tongue having, spaced from its base, a port or window. Each tongue is received in the window of the companion beam with some means for hooking or detenting the parts together in abutting relation.

An example of such a structure is shown in Sauer et al. U.S. Pat. No. 3,898,784. However, such construction has been found to lack tightness and security since reliance is placed, for locking purposes, upon a single detent at the center of each of the tongues, with cooperating detents directly engaging one another to provide a single pair of interfering surfaces of limited size about which relative twisting may take place, especially in the plane of the web, encouraging play or looseness in the joint. Nevertheless, once engaged, the sharp surfaces of the detents tend to remain stuck in their hooked position making disassembly both awkward and difficult. Finally, because of the nature of the joint, it is difficult to maneuver the ends into engagement at a distance of, say, six feet or more from the person doing the installing.

Other patents showing modifications of tongue and window assembly include Downing, Jr., et al. U.S. Pat. No. 3,221,466, O'Brien et al. U.S. Pat. No. 3,374,596, Stumbo et al. U.S. Pat. No. 3,565,474 and Cubbler, Jr., et al. U.S. Pat. No. 3,979,874. The structures shown in all of these patents possess one or more of the same disadvantages mentioned above; they do not provide optimum security, they are difficult to engage from a distance of several feet, are hard to unlock when disassembly becomes necessary and, in some cases, are expensive to form, for example, by reason of high tooling costs. The tongue-and-window idea has also been employed on cross beams at the point of joining with a main beam as indicated by Brown et al. U.S. Pat. No.3,221,846, but here the problems and solutions are different from making a beam splice.

It is, accordingly, an object of the invention to provide a joint or splice for a main beam, or runner, in a suspended ceiling system which has a higher degree of security and which insures a snug and precise fit between the abutting ends of a pair of beam sections. It is, more specifically, an object of the invention to provide a joint between abutting beam sections in which a tongue on each of the sections is securely anchored in a window in the other with no less than four pairs of locking surfaces which are distributed in the joint both vertically and horizontally, precluding relative rocking movement of the parts after they are assembled together. It is more specifically an object to provide a joint between abutted beams in which each tongue is provided with hooks along both the top and bottom edges thereof, and which are bent out of the plane of the tongue, for engaging the near edge of the window in the companion piece.

It is another object of the present invention to provide a splice for a beam in a ceiling system in which the joint is assembled by telescoping together the ends of a pair of beams into seated abutting position but in which the installer does not have to be right at the joint to perform the assembly but may, on the contrary, be located on a ladder six feet or more away from the joint location with assurance that the joint, once it "clicks" together, will be in secure and automatically perfect alignment.

It is another object of the invention to provide a joint, or splice, for a beam in a ceiling system which can be easily and quickly disassembled by applying a lateral component of withdrawal force when repair or replacement becomes necessary.

It is another object to provide a novel locking arrangement including a guide tang at the far edge of the window occupying a normal angled position but which may be bent reversely through an opening in the adjacent tongue to hold the tongue captive and thereby lock the joint against premature separation as a result of a shock, for example, a seismic disturbance.

It is moreover an object to provide a splice for a beam in a ceiling system which is easily installed, requiring a minimum of skill on the part of the installer, which does not require exercise of close tolerance in manufacture and which may be economically produced with relatively simple and inexpensive tooling.

Other objects and advantages of the invention will become apparent upon reading the attached detailed description and upon reference to the drawings in which.

While the invention has been described in connection with a preferred embodiment, it will be understood that I do not intend to be limited to the particular embodiment shown but intend, on the contrary, to cover the various alternative and equivalent constructions included within the spirit and scope of the appended claims.

Figure 1:
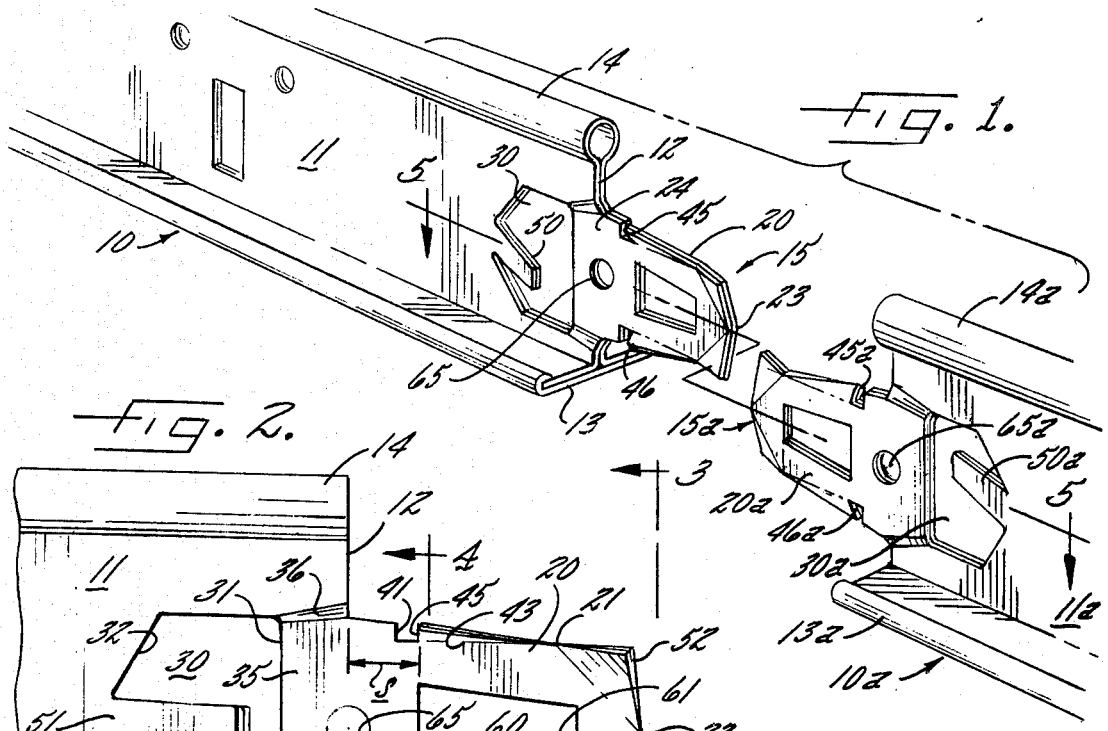
FIG. 1 shows, in perspective, the ends of a pair of beam sections oriented to form an abutted joint.
Figure 2:
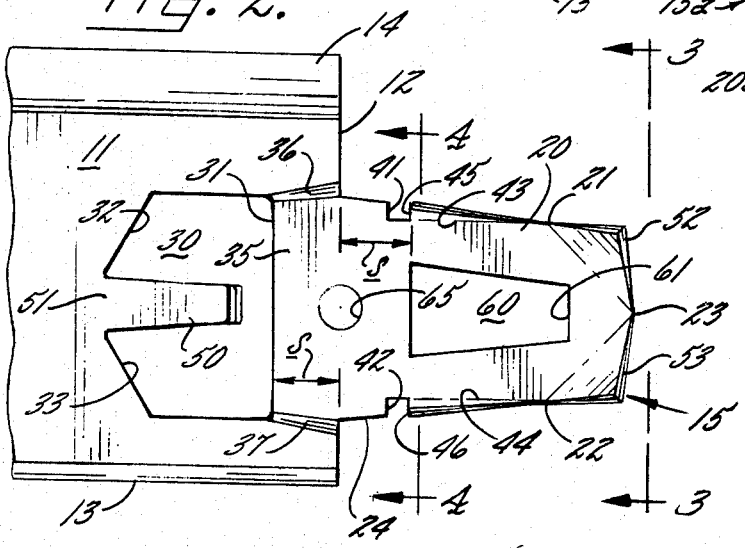
FIG. 2 is an enlarged end elevation showing the end of one of the sections.
Figure 4:
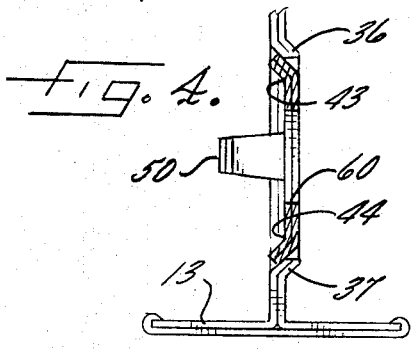
FIG. 4 is a section, in elevation, taken along line 4—4 in FIG. 2.
Figure 3:
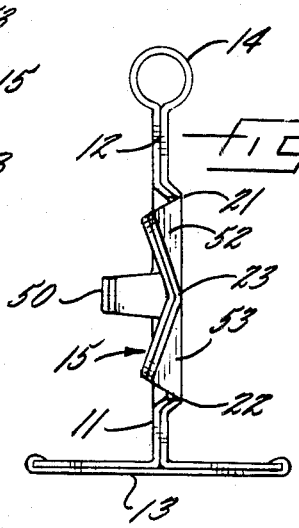
FIG. 3 is an end view looking along line 3—3 in FIG. 2.

Turning now to the drawings, and particularly to FIGS. 1 and 2, there is shown a main beam, or runner, 10 made of thin relatively soft steel and roll-formed to provide a central web 11 having an end 12, with a flange 13 extending at right angles along its lower edge in inverted "T" formation. The web is reinforced along its upper edge by a bead 14 which, in the present instance, is of circular cross section. The beam 10 has an especially formed end structure 15 which, when mated with identical structure on an abutted beam, results in a secure tightly fitted and smoothly merging joint. Portions of the identically formed companion beam, 10*a*, have been given similar reference numerals with addition of subscript a including the elements of the end structure to be described.

Focusing attention upon the beam 10, it is provided with a horizontally extending tongue 20 which is integral with the web 11. The tongue has upper and lower edges 21, 22, a tip portion 23, and a base or anchoring portion 24. Horizontally aligned with the tongue, and spaced inwardly from it, is a window 30, punch-formed in the web, the window having a "near" edge 31 and a "far" edge made up of two portions 32, 33, the window having a vertical dimension just slightly greater than the height of the tongue. The window is spaced inwardly from the end 12 of the web so that the near edge of the window defines a marginal portion 35 of the web bounded by creases 36, 37 top and bottom.

In accordance with the present invention the upper and lower edges 21, 22 of the tongue 20 are notched in the vicinity of the base as indicated at 41, 42 to form a neck of reduced dimension, and the edges 21, 22 are, in addition, bent out of the plane of the tongue along horizontal bend lines 43, 44 to form a pair of integral hooks 45, 46, the hooks being spaced longitudinally from the end of the web by an amount equal to the inward spacing of the near edge 31 of the window which serves to engage the hooks when the two beam sections are assembled together. In other words, when practicing the present invention, the inward spacing s (FIG. 2) of the window edge 31 from the end 12 of the web is substantially equal to the outward spacing s of the hooks 45, 46 from the same line of reference.

Figure 7:
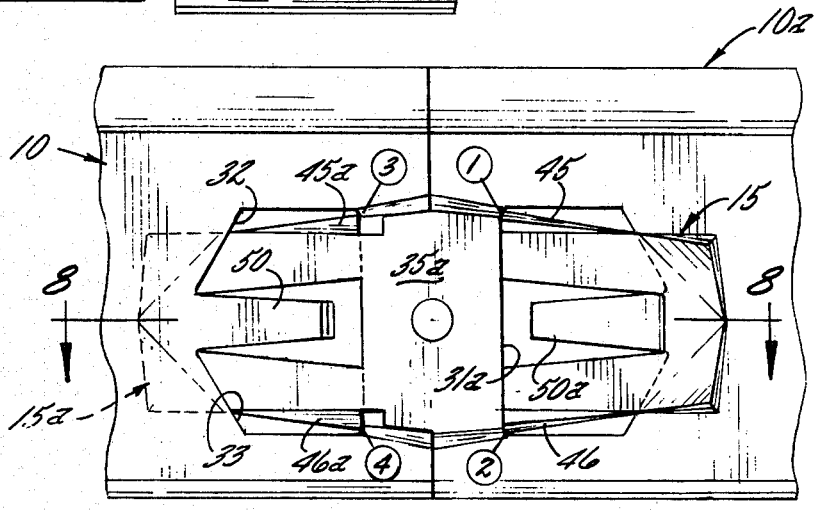
FIG. 7 is an elevational view showing the appearance of the assembled joint.
Figure 8:
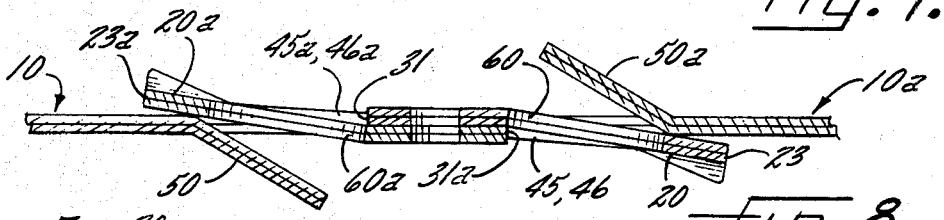
FIG. 8 is a horizontal section looking along line 8—8 in FIG. 7.

When the tongues of adjacent beam sections are respectively and simultaneously inserted, one into the window of the other, until the base portion of each tongue lies against the marginal portion of the companion beam, the hooks at the upper and lower edges of the tongue simultaneously catch behind the locking edges of the receiving windows. Thus as shown in FIG. 8 the hooks 45, 46 on the tongue 20 both snap behind the near edge 31*a* of the window 30*a*, while the hooks 45*a*, 46*a* on the companion piece snap behind the window edge 31. This produces four simultaneous points of engagement, or locking action, indicated at 1, 2, 3 and 4 (FIG. 7) which are widely spaced horizontally and vertically. This "spread" of the points of engagement not only insures a tight fit in the joint but strongly resists any relative twisting of the pieces, for example, in the plane of the webs, after they have been assembled together.

Figure 5:
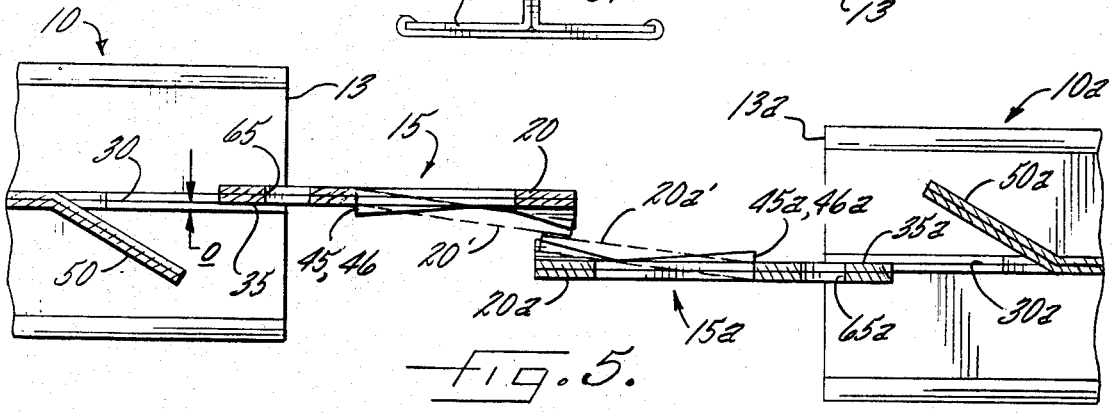
FIG. 5 is a horizontal section taken along line 5—5 in FIG. 1.

In carrying out the invention the marginal portion 35 of the web, adjacent the locking edge 31 of the window, is offset from the plane of the associated main portion of the web to insure that when the joint is assembled the webs and flanges are coplanar and in perfect alignment with one another. Such offset occurs along the crease lines 36, 37 which extend from the corners at the near edge of the window angularly outwardly to the end 12 of the web. The amount of the lateral offset, indicated at o in FIG. 5, is preferably about one-half of the web thickness. This permits the base portions of the two engaging tongues to overlap one another without their respective webs being moved out of coplanar relationship.

In accordance with the present invention the far edge of the window 32, 33 is provided with a lateral guiding element for guiding, or camming, the presented tongue into the window. The guiding element is preferably in the form of an integral horizontally-extending tang which occupies a normal position in which it is bent convergently out of the plane of the web so that when cooperating beam sections are brought into endwise engagement, the tips of the tongues thereon are engaged by respective tangs and simultaneously guided with a camming action into the window openings. The tang on the beam 10, indicated at 50, is bendable about its base 51 which is vertically centered along the far edge of the window.

Figure 6:
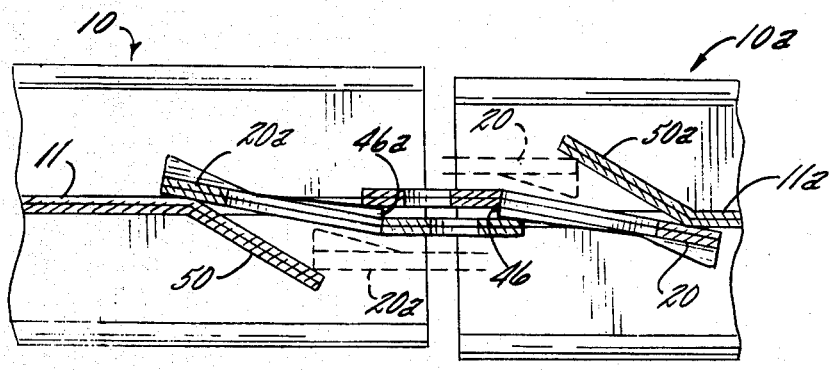
FIG. 6 is a stop motion view taken along the same section as FIG. 5 and showing progressive steps in the insertion.

The advantage of the tang as part of the combination may be appreciated when it is considered that it is commonly necessary for the installer to assemble the joint, or splice, between beam sections when high upon a ladder at a distance of six feet or more from the joint location. At this distance the installer has difficulty in seeing, much less controlling, the manipulation of the parts to be assembled. Using the present construction all that is necessary for the installer to do is to align beam sections approximately end to end, and push. When the tips of the two tongues simultaneously strike the angled tangs, as shown in stop motion in FIG. 6, the tangs serve as inwardly directed cams to guide and direct the tongues into their respective openings. Force is applied until the operator hears or feels a satisfying "click" notifying him that the parts are now tightly joined in abutting relation (FIG. 8).

To further insure that the tips of the tongues enter the respective windows, the tip of each tongue is locally bent in the direction of the window, that is, in the same direction as the tongue itself. Preferably, where the tip of the tongue has relatively sharp corners, the corners are individually bent at an angle to provide convergent upper and lower camming surfaces, the angularly bent corners being indicated at 52 and 53. In carrying out the invention the registering portions 32, 33 of the far edge of the window are, as indicated in FIGS. 2 and 7, also convergently angled. The advantage of bending the tip of the tongue in such symmetrically angled fashion and in correspondingly angling the rear edges of the window opening is to insure that once the tip of the tongue engages the tang the way is clear and the motion is continuous without any possibility of catching an edge or a corner and having to start over. It is one of the features of the present construction, therefore, that a tight and precise joint, or splice, may be easily and quickly made even by what may be termed "remote control" from a position six feet or more away.

Figure 9:
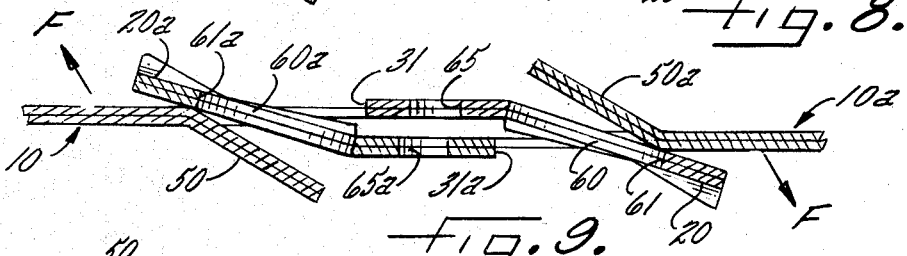
FIG. 9 is a view similar to FIG. 8 but showing angular application of force for disassembly.

Notwithstanding the tightness and security of the joint, however, it is one of the features of the construction that the hooks may be released, and the joint disassembled, simply by applying a withdrawal force having a lateral hook-disengaging component. Such component is, in a direction to move the webs of the two engaged sections out of their normal coplanar relation accompanied by flexing of the tongues against their resilient restoring force. This is illustrated in FIG. 9 which shows application of equal and substantially opposite forces F applied at an angle by firmly grasping the end of one section with one hand and the end of the other section with the other hand. It will be found that the hooks are immediately disengaged from their retaining edges so that the two beam sections may be easly and quickly drawn apart. This highlights one of the features of the invention, namely, that while the joint is tight and permanent as far as pure endwise forces are concerned, the joint is nonetheless easily releasable by applying intentional force in an angular direction. The result is that individual sections may be quickly separated for repair or replacement, and a set of beams comprising an entire ceiling system may be disassembled and taken down in a fraction of the time customarily required.

Figure 10:
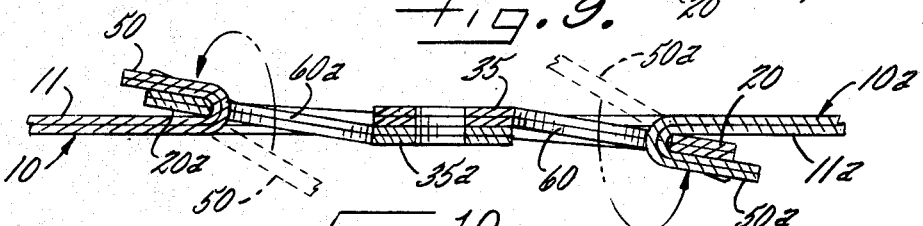
FIG. 10 is a section similar to FIG. 8 but illustrating the optional locking function of the guidance tangs.

It is nevertheless one of the features of the invention that a joint may, as an option, be positively locked together, a desirable and sometimes mandatory feature in areas prone to seismic disturbance. Thus, in accordance with the invention, each tongue is formed with a tang-receiving opening having a profile providing clearance with respect to the profile of the tang so that the tang may be sharply bent through the opening in the adjacent tongue for positive retention. Thus as shown in the drawings each tongue 20 has a tang-receiving opening 60 having a locking edge 61 which lies opposite the bend 51 of the tang when the joint is in its assembled condition. To lock the parts captive with one another, the tang 50 is reversely bent through the opening 60 from the dot-dash position illustrated in FIG. 10 to the fully bent position. Since the tang 50 is relatively narrow, laminated, and therefore easily bendable, the tang may be pushed through the opening by a screwdriver or similar tool, with the bending motion being completed easily and quickly by the thumb of the installer. Either one or both of the tangs in a given joint may be bent into locking position, as may be desired.

It is, however, one of the features of the construction that the joint may be just as readily unlocked by reversing the bend and by pushing the tang back through the opening 60 into its initial position.

It is a still further feature of the construction that, formed in the base of the tongue and in alignment with the end 12 of the web, is a circular opening 65 which, when the joint is assembled, registers with a similar opening 65*a* in the companion piece. The aligned openings may be used to receive the end of a suspension wire dropped from the ceiling or, alternatively, may be used to receive a self-tapping screw for locking purposes.

It will be apparent that the construction described above amply fulfills the objects set forth in the introduction. Assembly of the adjacent beam sections into a tight rigid joint becomes simply a matter of pushing them together in a generally aligned relation, something which may be accomplished from a distance thereby reducing the necessity for frequent movement of a ladder or scaffolding. The parts are so formed that once started they go together easily without any catching of corners or edges. Once the sections have been snappped together they are locked in perfectly aligned relation, the flanges forming a practically invisible flush joint all without care or thought on the part of the operator.

Since the joint employs four hooks simultaneously engaged and which are widely spaced both vertically and horizontally, there is no possibility of relative twisting of the parts, particularly in the plane of the web. In spite of the tight permanence of the joints, disassembly is quick and easy using the simple expedient of applying a withdrawing force having a hook-disengaging lateral component.

Because of the provision which has been made for disengagement, it is preferred to use hooks which are sharp and positive. However, if even easier disengagement is desired, the hooks 45, 46 may be angled or slightly rounded without departing from the invention.

Also while it is preferred to employ a tang 50 which is relatively narrow at the base 51 to facilitate manual bending, it will be understood that the term "tang" as used herein refers to an angled surface at the far edge of the window performing a camming and guiding function upon the entering tongue regardless of whether it is readily bendable by manual manipulation.

It is found, as a practical matter, that the necessary shapes discussed above which characterize the present construction may be formed with simple tooling to produce consistent results without the necessity for adhering to close tolerances. It is found further that the conventional soft grade of steel rolled to conventional thickness customarily employed in formation of beams, or runners, and cross members provides just about the right amount of resilience to achieve the effects described.

The invention has been described assuming that the tongues 20 are in the initially "straight" orientation illustrated in FIG. 5. However, if desired, and without departing from the invention, each of the tongues may be "pre-bent" through a small angle in the direction of the window of the opposite piece, as indicated at 20' in FIG. 5, to facilitate entry of the tongue into the window, particularly where the amount of offset of the tip of the tang is less than that which has been illustrated. Each tongue should nevertheless be sufficiently straight with respect to the plane of the associated web so that the tongue upon being received in the window of the companion beam is bent and bears with resilient lateral force against the far edge of the window causing the hooks to catch behind their locking edges to a predetermined and reliable depth. Engagement between the tongue and the far edge of the window tends to correct any mis-angling of the tongue, for example that occurring during shipment or handling, over a wide range of tolerance. Stated in other words, the parts need not be geometrically precise prior to assembly in order to secure precise and consistent results.

What I claim is:

1. In a suspended ceiling system, a pair of companion beams joinable end to end in aligned relation, each of the beams having a vertical web and a lower flange at right angles thereto, the beams having identically formed end portions each terminating in a horizontal tongue having a tip and upper and lower edges and anchored at a base portion which is an integral extension of the web, each web having formed therein a window aligned with the adjacent tongue and having a far edge and a near edge, the window having a vertical dimension just slightly greater than the height of the tongue, the window being spaced inwardly from the end of the web so that the near edge of the window defines a marginal portion of the web with the near edge of the window serving in addition as an inwardly spaced locking edge, means at the far edges of the windows for guiding the tongues of the beams simultaneously into their respective windows until the two beams abut one another and until the base portion of each tongue lies against the marginal portion of the companion beam, each marginal portion being offset from the plane of the associated web by an amount equal to substantially one-half of the web thickness to insure that when assembled the webs and flanges are coplanar and in perfect alignment with one another, each of the tongues being notched and bent along its upper and lower edges to form a pair of integral hooks, the hooks being spaced from the end of the web by an amount equal to the inward spacing of the locking edge, each tongue being sufficiently straight with respect to the plane of the web so that the tongue upon being received in the window of the companion beam is bent and bears with resilient lateral force against the far edge of the window causing the hooks to catch behind their locking edges to a predetermined reliable depth while permitting the tongues to be withdrawn from the windows by a withdrawing force applied at an angle with a lateral component in a direction to bendingly stress the tongues for disengagement of the hooks.

2. The combination as claimed in claim 1 in which the guiding means at the far edge of each window is in the form of an integral horizontally-extending tang vertically centered with respect to the window, the tang being bent convergently from the plane of the web to be in the path of movement of the tip of the presented tongue.

3. The combination as claimed in claim 2 in which each tongue is formed with a tang-receiving opening having a profile providing clearance with respect to the profile of the tang and in register therewith so that the tang may be bent sharply through the opening for positive retention of the tongue.

4. The combination as claimed in claim 1 in which the tip of the tongue is bent in the same direction as the tongue itself to facilitate entry of the tongue into the window and to provide a camming surface for guiding the tip of the tongue past the far edge of the window.

5. The combination as claimed in claim 2 in which the tip of the tongue has relatively sharp corners, the corners being convergently bent at an angle in the same direction as the tongue itself to provide separated camming surfaces and in which the portions of the far edge of the window which are adjacent the tang are correspondingly angled for engagement by the respective camming surfaces.

6. The combination as claimed in claim 1 in which a hole is provided in the web centered between the end of the web and the base of the tongue of each beam so that the holes in the beams are aligned when the beams are in abutting relation for optional reception of a wire or self-tapping screw for locking the beams together.

7. In a suspended ceiling system, a pair of companion beams joinable end to end in aligned relation, each of the beams having a vertical web and a lower flange at right angles thereto, the beams having identically formed end portions each terminating in a horizontal tongue having a tip and upper and lower edges and anchored at a base portion which is an integral extension of the web, each web having formed therein a window aligned with the adjacent tongue and having a far edge and a near edge, the window having a vertical dimension just slightly greater than the height of the tongue, the window being spaced inwardly from the end of the web so that the near edge of the window defines a marginal portion of the web with the near edge of the window serving in addition as an inwardly spaced locking edge, the far edge of the window having thereon in a vertically centered position a lateral guiding element in the form of an integral horizontally extending tang bent convergently out of the plane of the web so that when the beams are brought into endwise engagement the tongues of the two beams are simultaneously cammingly guided into respective windows until the two beams abut one another and until the base portion of each tongue lies against the marginal portion of the companion beam, each marginal portion being laterally offset from the plane of the associated web to insure that when the beams are fully engaged the webs and flanges are coplanar and in perfect alignment with one another, each of the tongues being notched and bent along its upper and lower edges to form a pair of integral hooks, the hooks being spaced longitudinally from the end of the web by an amount equal to the inward spacing of the locking edge so that when the beams are in abutting relation each pair of hooks catches behind a respective locking edge, the tongues having sufficient resilience in the lateral direction so that the tongues may be withdrawn from the windows by a withdrawing force applied to the joint at an angle with a lateral component in a direction to bendingly stress the tongues for disengagement of the hooks.

* * * * *